US005573408A

United States Patent [19]

Laub et al.

[11] Patent Number: 5,573,408

[45] Date of Patent: Nov. 12, 1996

[54] MICROPITCH CARD EDGE CONNECTOR

[75] Inventors: Michael F. Laub, Etters; William J. Schnoor, Hummelstown, both of Pa.

[73] Assignee: The Whitaker Corporation, Wilmington, Del.

[21] Appl. No.: 269,255

[22] Filed: Jun. 30, 1994

[51] Int. Cl.[6] ..... H01R 9/09

[52] U.S. Cl. ..... 439/62; 439/636; 439/876

[58] Field of Search ..... 439/62, 636, 876, 439/634–636

[56] References Cited

U.S. PATENT DOCUMENTS

| | | | |
|---|---|---|---|
| 3,848,951 | 11/1974 | Michaels et al. . | |
| 4,487,468 | 12/1984 | Fedder et al. | 439/635 |
| 4,850,892 | 7/1989 | Clayton et al. | 439/326 |
| 4,869,672 | 9/1989 | Andrews Jr. | 439/636 |
| 4,917,614 | 4/1990 | Kikuchi et al. | 439/83 |
| 5,052,936 | 10/1991 | Biechler et al. | 439/636 |
| 5,203,725 | 4/1993 | Brunker et al. | 439/62 |
| 5,295,841 | 3/1994 | Grabbe et al. | 439/83 |
| 5,383,792 | 1/1995 | Korsunsky et al. | 439/636 |
| 5,387,115 | 2/1995 | Kozel et al. | 439/636 |
| 5,393,234 | 2/1995 | Yamada et al. | 439/62 |
| 5,433,616 | 7/1995 | Walden | 439/62 |

FOREIGN PATENT DOCUMENTS

| | | | |
|---|---|---|---|
| 0138368 | 4/1985 | European Pat. Off. | 439/62 |

*Primary Examiner*—David L. Pirlot
*Assistant Examiner*—Jue Demello
*Attorney, Agent, or Firm*—June Schuette

[57] ABSTRACT

An electrical edge connector housing (1), for mounting onto a printed circuit board substrate (100), has walls that form a plurality of slots (3) and a respective plurality of chambers (2). Each slot (3) is positioned on an opposite side of a substrate receiving groove (13) from a chamber (2). Each slot (3) and chamber (2) receives a contact (18) therein for connection to the substrate (101) received within the groove (13). A retention clip (40) cooperates with an alignment block (50) to align and retain the substrate (101) within the housing (1).

6 Claims, 12 Drawing Sheets

MICROPITCH CARD EDGE CONNECTOR

BACKGROUND

In response to a trend in the electronics industry toward increased functionality and miniaturization, the number and complexity of integrated circuits required is increasing while the amount of area available to receive integrated circuit packages on a printed circuit board substrate is decreasing. Integrated circuits, microprocessors in particular, have an increasing array of functionality, have greater numbers of input/output("I/O") ports and are running at higher clock rates. Microprocessors implement some of their functionality through use of cache memory. The speed in which microprocessors perform a certain functions is related to the time required to access cache. There is limited cache memory directly on microprocessor chips where access time is at a minimum. In certain cases, however, some functions performed by microprocessors, require access to greater blocks of cache than is available directly on the microprocessor chip. Rather than provide very large blocks of memory directly on the microprocessor chip, those microprocessor functions requiring a large block of cache use memory remote of the microprocessor. As the speed of the function is inversely related to the access time, it is important to minimize the access time to the remote memory and desirable to have as much cache memory available as possible. One way to minimize the access time is to minimize the electrical length of the connection between the I/O ports on the microprocessor, or other integrated circuit, and the I/O ports on memory to which the microprocessor communicates. One method of increasing memory capacity and decreasing both electrical length and physical size is to mount multiple integrated circuit memory chips onto a single substrate. This type of assembly is typically termed a multichip module. Multichip modules minimize excess packaging, excess packaging being associated with increased electrical length. Therefore, there is a need to socket memory modules as closely as possible to the microprocessor or other circuitry that accesses them.

In keeping with the goal of miniaturization, these sockets must take up a minimum amount of area on a printed circuit board substrate. There are many different types of low profile sockets such as the one disclosed in U.S. Pat. application Ser. No. 08/075,698 that discloses a low profile integrated circuit socket. Low profiles are important in cases where many printed circuit boards are stacked closely together creating limited clearance from board to board. Under certain circumstances, however, it is less important for a socket to have a low profile, but crucial that the socket have a small footprint. In addition, a standard industry requirement is that the sockets and corresponding multichip modules be able to withstand at least 100 Gs of physical shock without experiencing an electrical discontinuity greater than one microsecond in duration. There is a need, therefore, for an integrated circuit socket having a small footprint and a short electrical length capable of withstanding 100 Gs of physical shock without experiencing significant electrical discontinuity.

Multichip module substrates may be made of, among other materials, ceramic, aluminum and laminates. Conductive traces on the substrate make an electrical connection between I/O ports on the multichip modules and leads on the edge of the substrate. The leads may be on a single side of the substrate on 0.0125 inch centerline spacings. Alternatively, half of the leads may extend to an edge on one side of the substrate, and the remaining half of the leads may extend to the opposite side in a double sided substrate. In the double sided substrate, leads may be on 0.025 inch centerline spacings. It is the size of the substrate, the number of leads on the substrate, and the placement of the leads that dictate the appropriate number of leads and the substrate configuration, both of which can vary widely. Certain socket applications tend to be relatively low volume rendering it difficult for a socket manufacturer to offer low cost through economies of scale. In a competitive market environment where time to market is of the essence and the supplier with the lowest cost has a competitive advantage, it is important to be able to respond to industry needs quickly and at a minimum cost. There is a need, therefore, for a manufacturable multichip module socket design applicable to both single sided and double sided substrates of varying lengths.

The advent of surface mount solder processing contributed to higher density industry applications due to the capability to achieve smaller centerline spacings for adjacent solder contacts. The most common current industry capability for surface mount soldering at acceptable yields is on 0.025 inch centerline spacing. It is advantageous, therefore, to have a socket that is able to interface 0.0125 inch centerline spacing of integrated circuit substrates with 0.025 inch centerline spacing of current solder processing capabilities. Furthermore, it is expected that solder processing capabilities will improve in the relatively near future as technology progresses. There is, therefore, a need for a high density socket having a footprint compatible with current processing capabilities and adaptable to next generation processing capability.

SUMMARY OF THE INVENTION

The invention provides an electrical edge connector or socket housing having walls that form a plurality of slots, and a respective plurality of chambers. Each slot is positioned opposite a chamber.

The invention further provides an electrical edge connector comprising an edge connector housing having walls that form a plurality of slots and a respective plurality of chambers and a contact received by the housing. The contact has a retention arm, a contact arm, and a solder tail.

The invention further provides an electrical edge connector housing comprising a first housing having a substrate receiving groove and a second housing having a substrate receiving groove. The first housing has a fastening member and the second housing has a complementary fastening member, the fastening member being engageable with said complementary fastening member to create a larger electrical connector housing having a single substrate receiving groove.

The invention further provides an apparatus for retaining a substrate to a printed circuit board in substantial perpendicular alignment thereto. A retention clip having a tab and upper lip engages an alignment block and a substrate therebetween.

Other advantages of the invention are apparent by way of example from the following detailed description in conjunction with the accompanying drawings.

DETAILED DESCRIPTION OF THE PREFERRED EMBODIMENT

Figure 1:
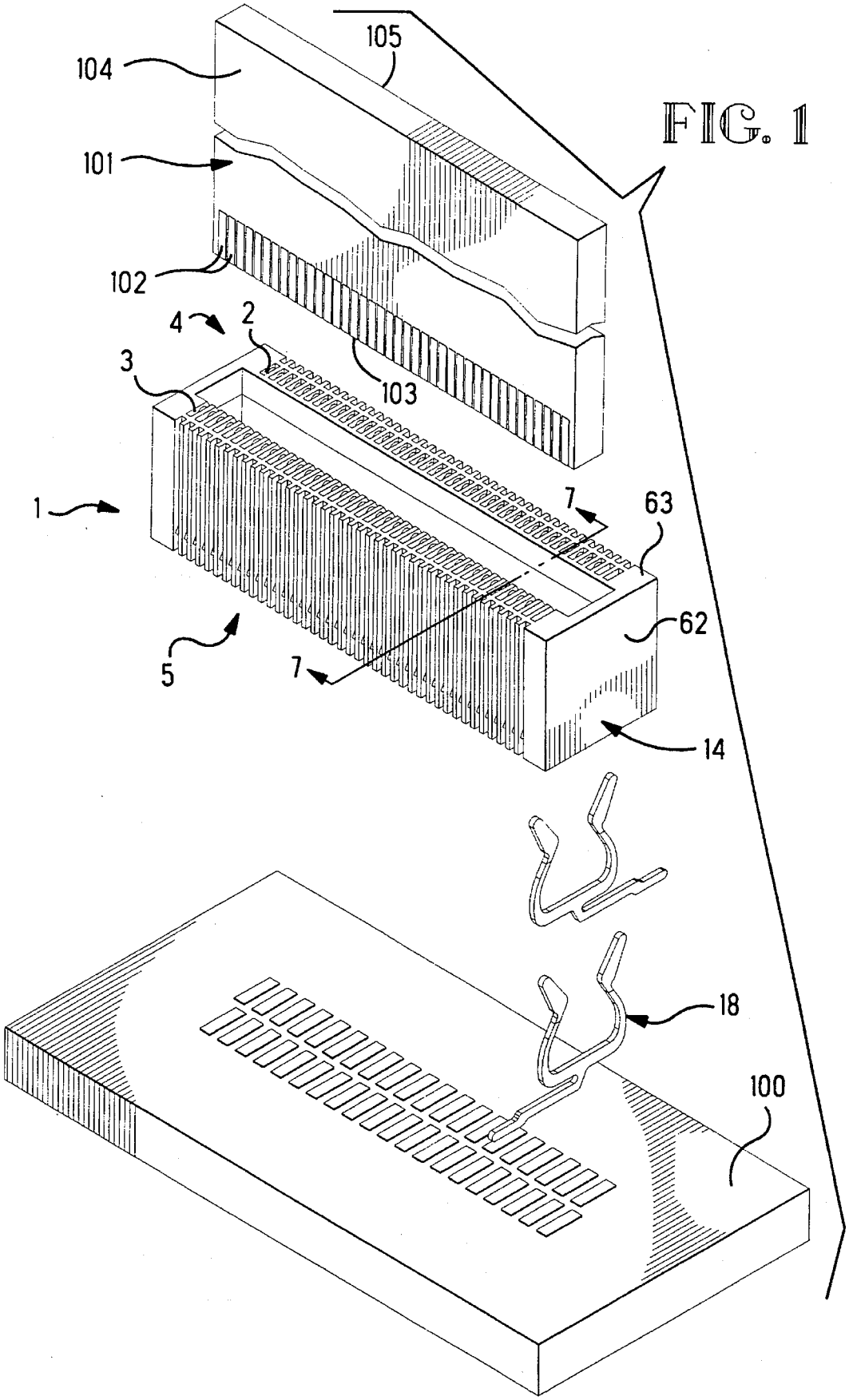
FIG. 1 is an exploded perspective view of a connector housing and associated contact in relation to a substrate and a printed circuit board.
Figure 2:
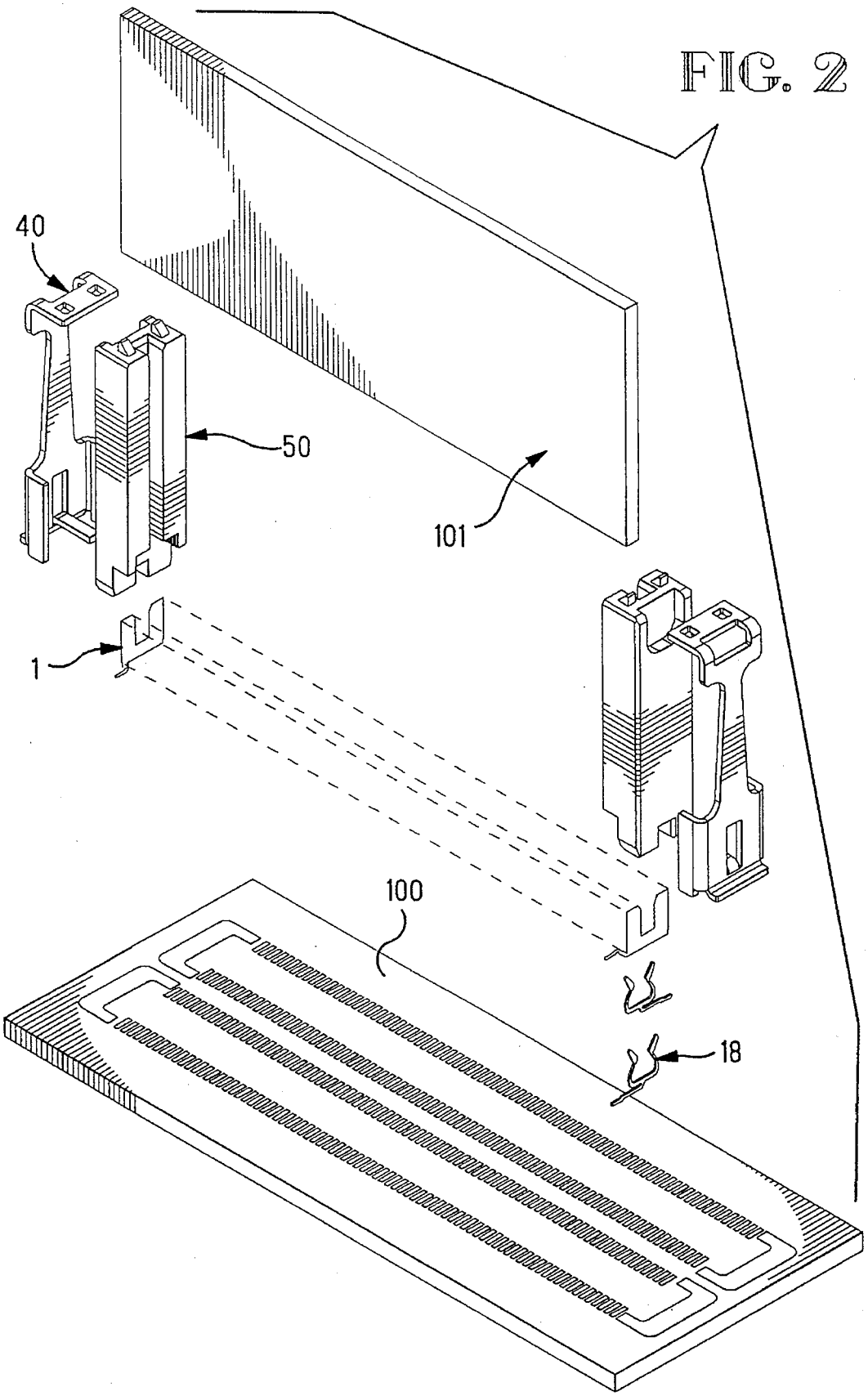
FIG. 2 is an exploded perspective view of a connector housing, in phanton view end blocks, and associated contact in relation to a substrate and a printed circuit board. An enlarged detail view of the housing with a middle portion removed in shown in FIG. 10.

With reference to FIGS. 1 and 2, an edge connector or socket is mounted onto a printed circuit board 100 to receive a multichip module substrate 101 perpendicular thereto. The substrate 101 typically is of ceramic or aluminum although it could be a laminate structure as well. Conductive paths-(not shown) connect I/O ports on the integrated circuit to leads 102 at an edge 103 of the substrate 101. In a single-sided substrate, all leads 102 reside on one substrate edge 103 on 0.0125 inch centerline spacings and on one side 104 of the substrate 101. In a double sided substrate, all leads 102 reside on one substrate edge 103. A subset of the leads, typically half, reside on one side 104 of the substrate on 0.025 inch centerline spacings, and the remaining leads reside on an opposite side 105 of the substrate also on 0.025 inch centerline spacings.

An edge connector housing 1, appropriate for receipt of either the single sided or the double sided substrate, is a single piece injection molded item having walls that form a plurality of chambers 2 and a respective plurality of slots 3. The chambers 2 and slots 3 are positioned on 0.0125 inch centerline spacings for intended registration with the substrate leads 102 having corresponding centerline orientation. The chambers 2 and the slots 3 are open at a top 4 and at a bottom 5.

Figure 3:
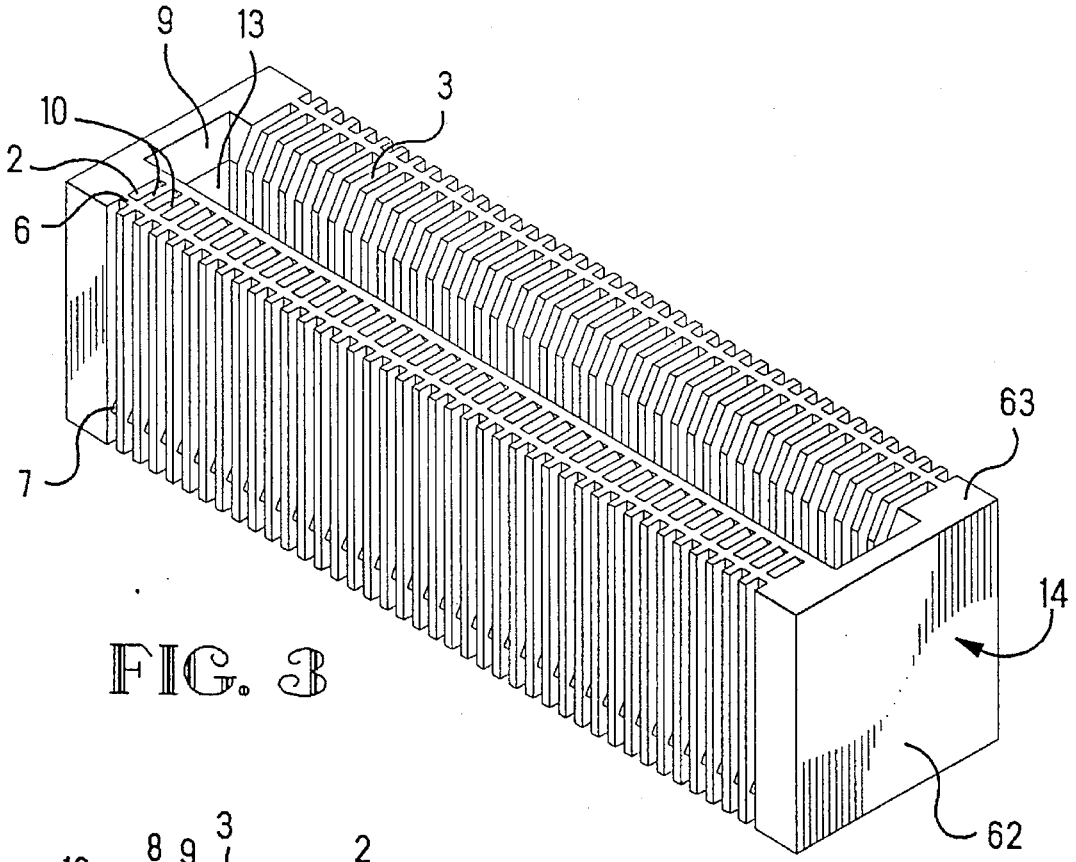
FIG. 3 is a top perspective view of a single sided substrate housing.
Figure 4:
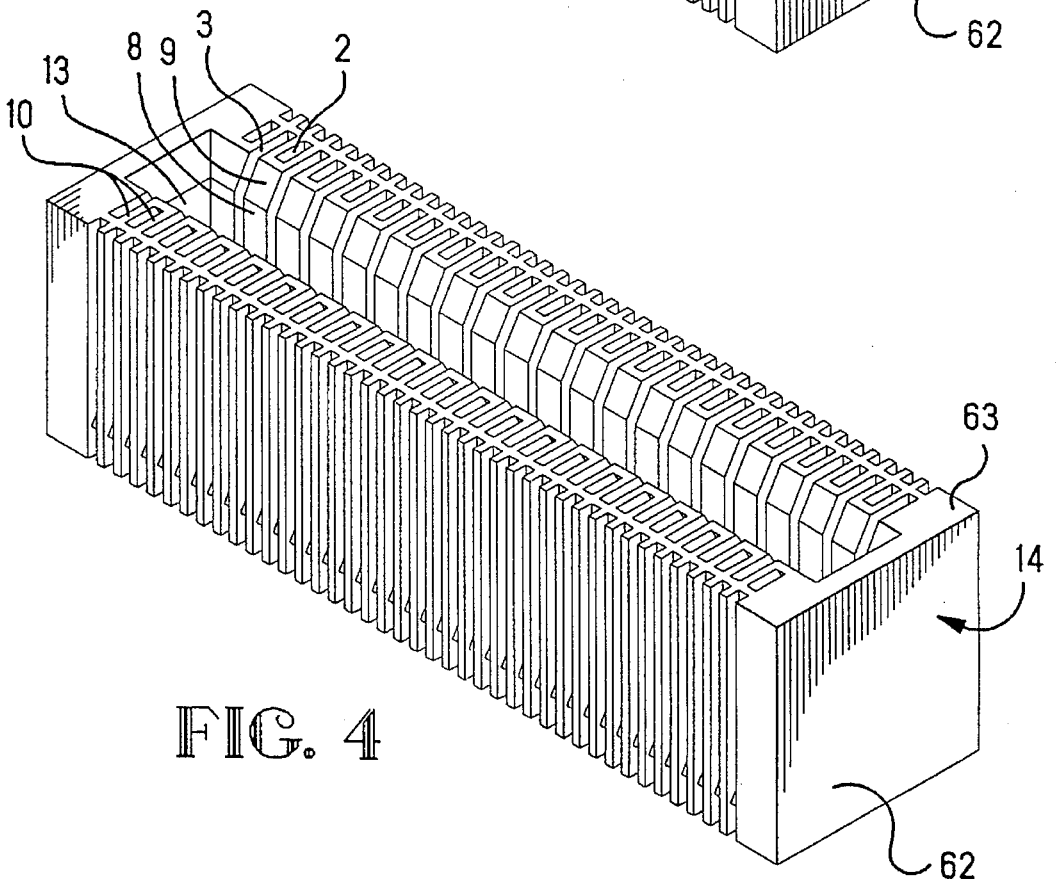
FIG. 4 is a top perspective view of a double sided substrate housing.
Figure 5:
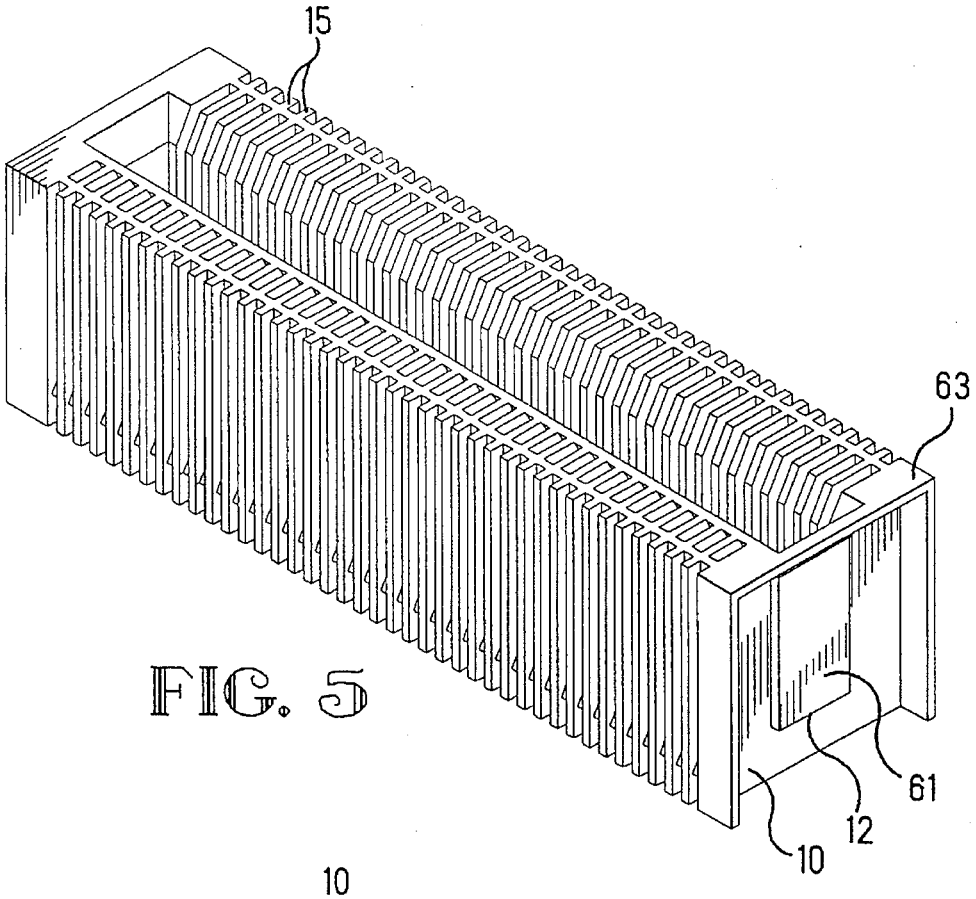
FIG. 5 is a top perspective view of a single sided substrate housing with a partial cutaway view of an end of the housing.
Figure 6:
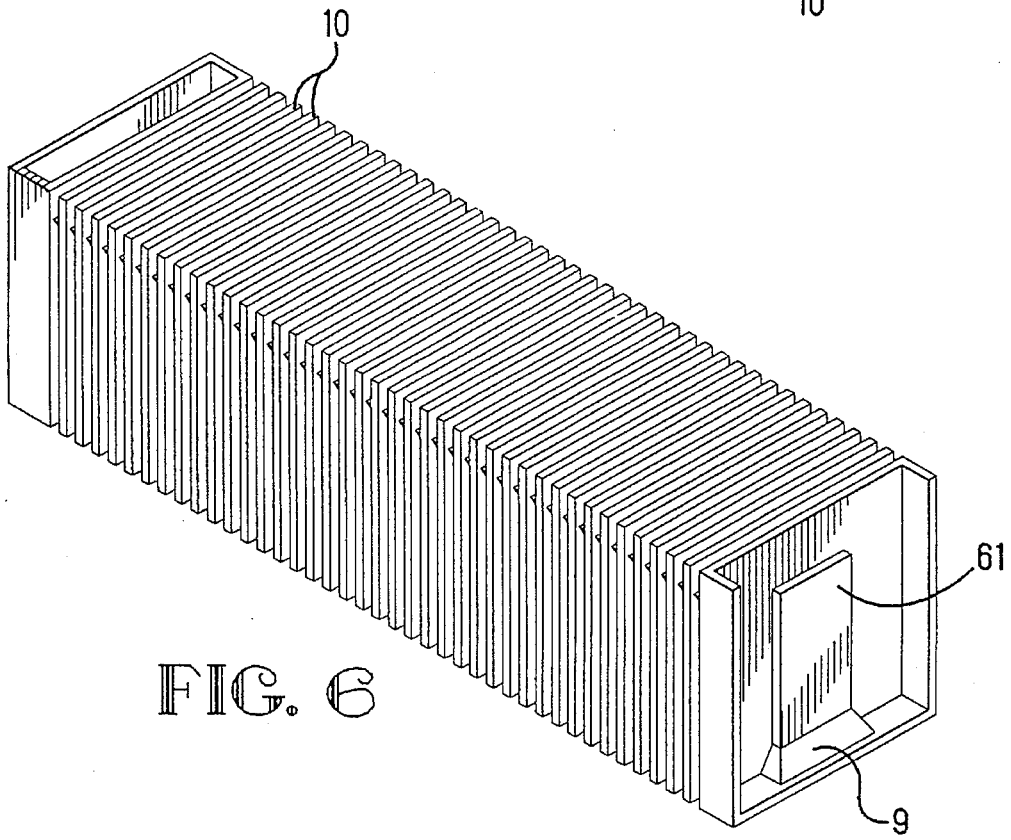
FIG. 6 is a bottom view of the housing with a partial cutaway view of an end of the housing.
Figure 7:
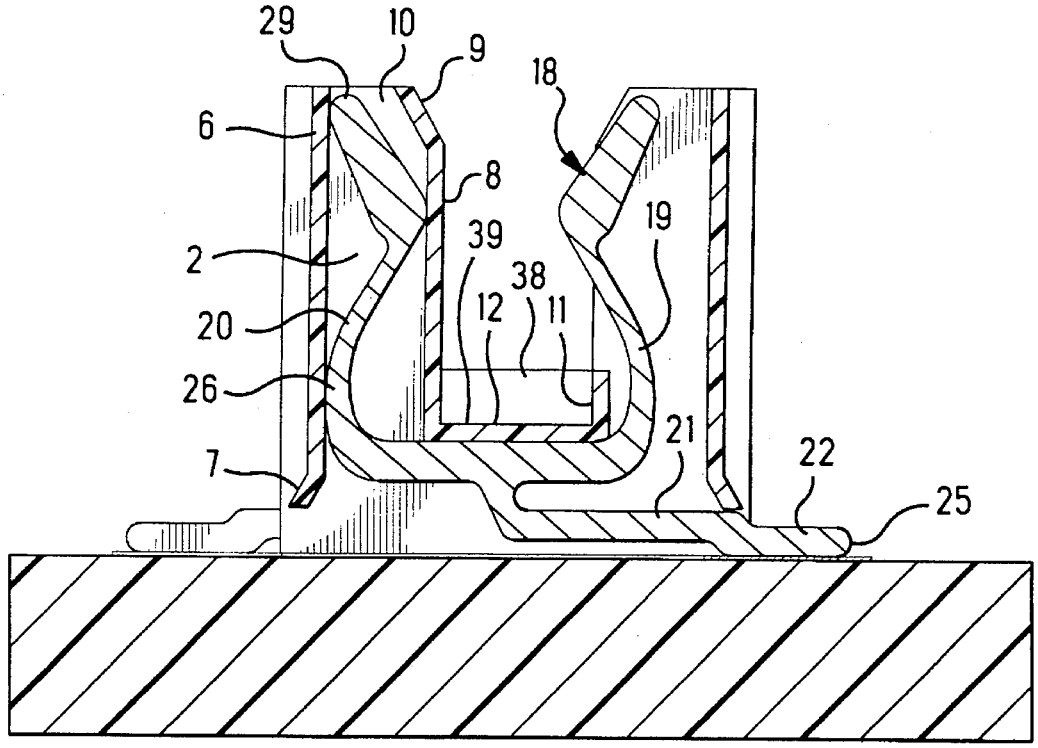
FIG. 7 is a cross sectional view cut along axis 7—7 of FIG. 1 showing the placement of a contact within the housing without a substrate in the groove.

With reference to FIGS. 3, 4, and 7, each chamber 2 comprises four connected walls oriented at right angles with respect to each other: an outer wall 6, an inner wall 8, and two side walls 10 . A cross section of the chamber 2 is best shown in FIG. 7. The outer wall 6 is planar and has an outward flare 7 at the bottom 5 of the chamber 2. In a preferred embodiment, all walls are of substantially uniform thickness. The wall thickness is approximately 0.0055 inches. As all walls are of uniform thickness, the outward flare 7 appears at both an interior and exterior of the slots 3 and chambers 2. The inner chamber wall 8 is substantially planar with a bevel 9 toward the top 4. Two side walls 10 are substantially parallel planar surfaces. The side walls 10 of the chambers 2 connect the inner chamber wall 8 and the outer chamber wall 6, enclosing four sides of the chamber 2. The side walls 10 follow the contours of the bevel 9 and extend towards a bottom 5 of the housing 1 to rest against the printed circuit board substrate 100.

The outer wall 6, and two side walls 10 of each slot 3 have a shape and size substantially similar to the outer and side walls comprising the chamber 2. An inner slot wall 11 is substantially planar and extends towards a top 4 of the housing 1 a distance approximately one third that of the inner chamber wall 8. A remaining distance of the inner slot wall 11 is open, the opening being indicative of the slot 3.

The inner chamber wall 8 and the respective inner slot wall 11 are connected via a cross wall 12 positioned at a right angle with respect to the inner chamber wall 8 and the inner slot wall 11. The inner chamber wall 8, the inner slot wall 11, and the cross wall 12, thus connected create a substrate receiving groove 13. The bevel 9 on each inner chamber wall 8 and on each side wall 10 provides a lead in surface along and on either side of the groove 13. Support walls 38 are oriented at intervals across the lower portion of the groove 13. The support walls 38 extend from a groove floor 39 up to approximately one third the length of the inner chamber wall 8. The support walls 38 are coincident with each side wall 10. Opposing side walls 10 are thus connected by the support walls 38.

With reference to FIGS. 1 and 3 through 6, in an embodiment of the housing 1, two housing ends 14 delineate the length of the groove 13. One embodiment of the housing end 14 is unitary with the housing and comprises end walls 61, 62, and 63. Inner end walls 61 have a rectilinear U-shaped cross section and enclose the groove 13. The inner end wall 61 towards the bottom 5 of the housing 1 connects to the cross wall 12 and is perpendicular thereto. The inner end walls 61 are beveled toward the top 4 of the housing 1 and follow an angle and length substantially similar to that of the bevel 9 that is associated with the slots 3 and chambers 2. Each inner end wall 61 has an exterior surface that locates side edges of the multichip module substrate 101 for proper horizontal registration of the leads 102 with the slots 3. Outer end walls 62 have a rectilinear U-shaped cross section wider than that of the inner end walls 61 such that the cross section of the outer end walls 62 is parallel to and encompasses the cross section of the inner end walls 61. The outer end walls 62 and the inner end walls 61 are connected via a top end wall 63 having a U-shaped cross section. The top end wall 63 is substantially perpendicular to the inner end wall 61 and the outer end wall 62. The inner end wall 61, the outer end wall 62, and the top end wall 63 thus connected, create a cavity. Ends of the outer end walls 62 are coplanar with ends of the side walls 10 and rest against the printed circuit board substrate 100.

Rib walls 15 extend outwardly of the housing 1. Each rib wall 15 extends outwardly along a line defined by the respective side walls 10. Each side wall 10, therefore, has a respective rib wall 15 of substantially the same thickness that extends therefrom. An outermost end of the flare 7 does not extend beyond the outermost end of the rib wall 15. All slots 3 and chambers 2 are on 0.0125 inch centerline spacings. In a single sided housing as in FIG. 3, all Chambers 2 lie on one side of the groove 13 and all slots 3 lie on a side opposite the one side of the groove 13. The single sided housing receives a single sided substrate 101 wherein all leads on the substrate 101 lie on one edge 103 of one side 104 of the substrate 101. The single sided substrate 101, therefore, has leads on 0.0125 inch centerline spacings. In a double sided housing as in FIG. 4, each chamber 2 is adjacent a slot 3 and each slot 3 is adjacent a chamber 2. In the double sided housing, slots 3 on both sides of the groove 13 are on 0.025 inch centerline spacings. The double sided housing receives a double sided substrate (not shown) wherein all leads lie on one edge of the substrate with leads on one side of the substrate at 0.025 inch centerline spacing and the remaining leads on an opposite side of the substrate also on 0.025 inch centerline spacing. Leads on one side of the double-sided substrate must be laterally offset 0.0125 inches from the leads on the opposite side of the substrate for proper registration with slots 3 in the housing 1.

Figure 8:
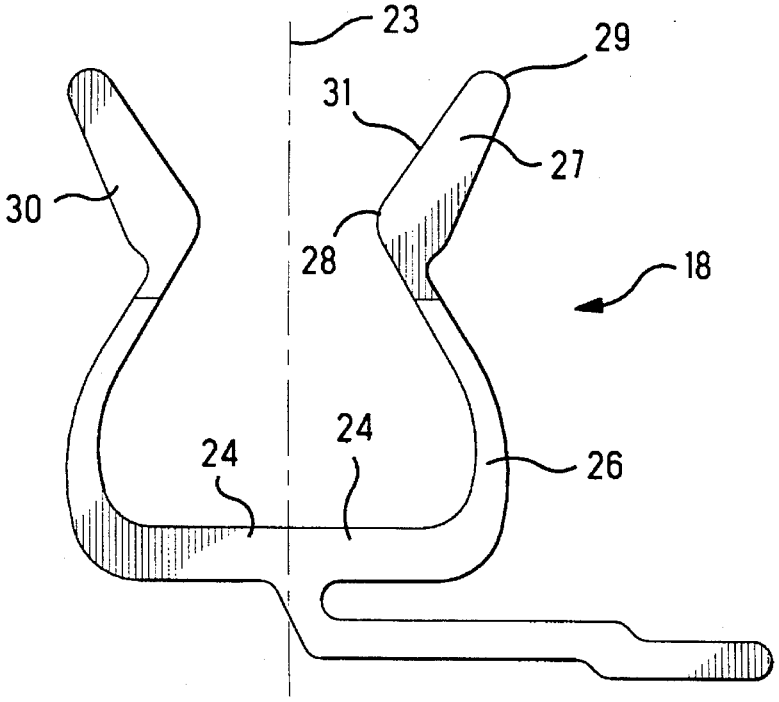
FIG. 8 is a plan view of a contact.
Figure 9:
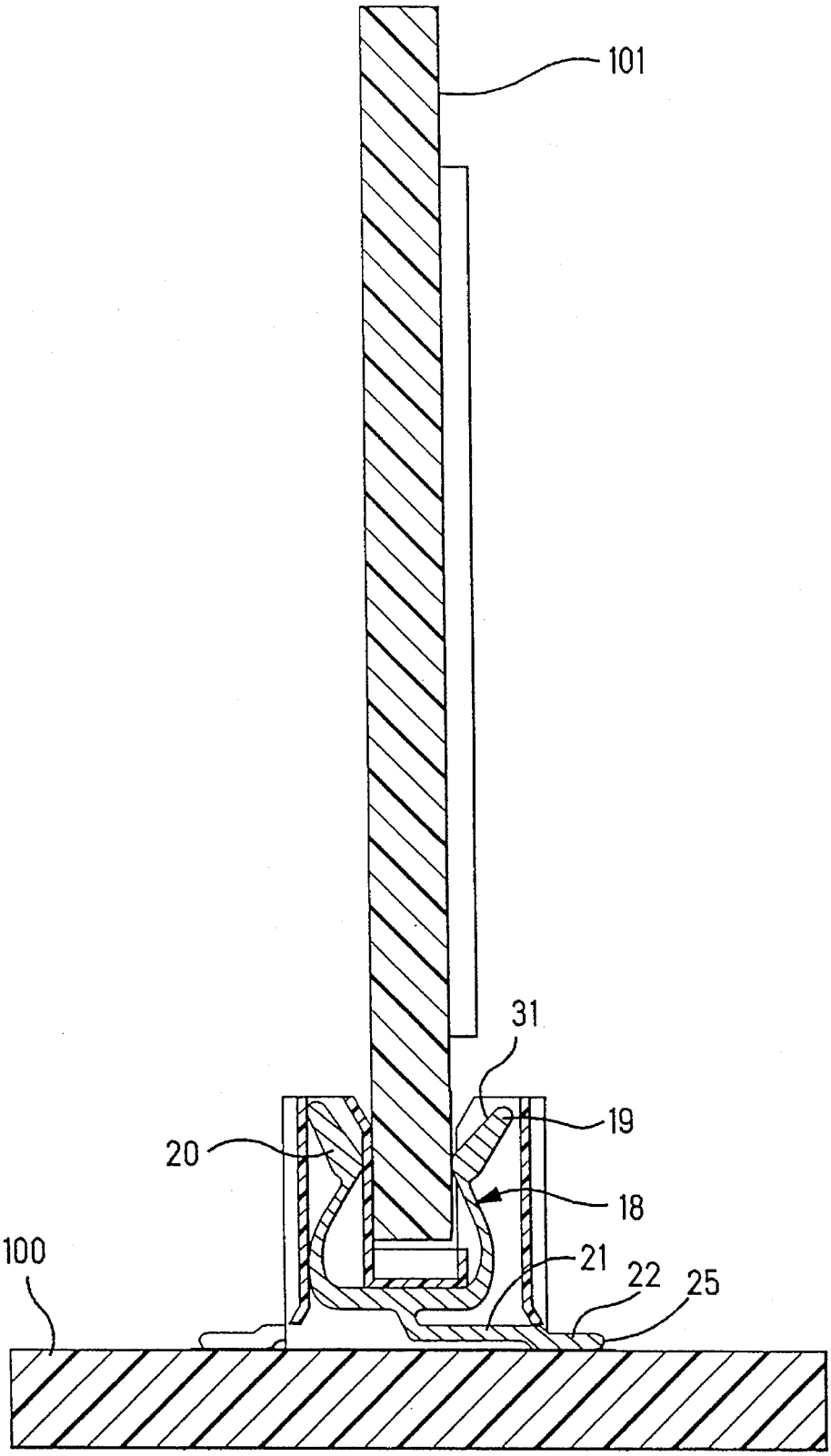
FIG. 9 is a cross sectional view cut along axis 7—7 of FIG. 1 showing the placement of a contact within the housing with a substrate in the groove.
Figure 10:
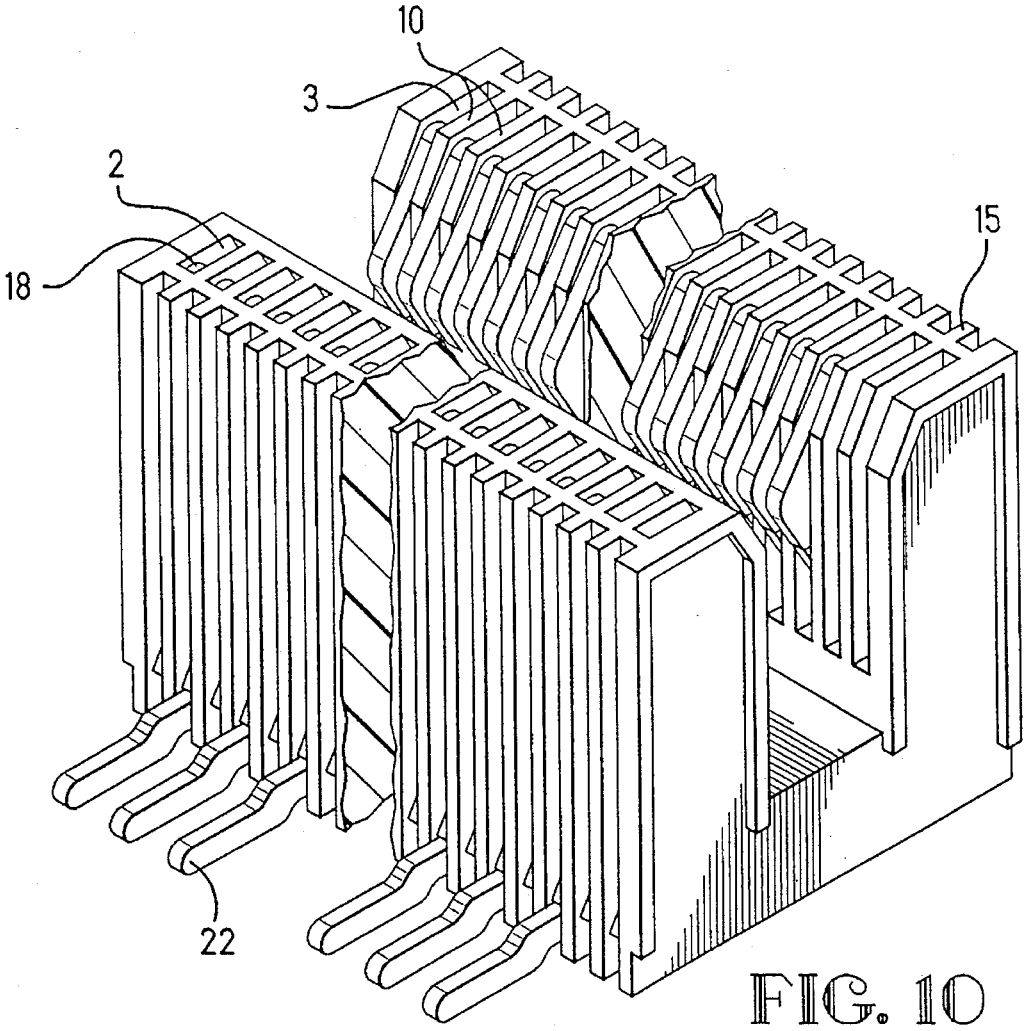
FIG. 10 is a top detail view of a contact within a housing.

The connector housing 1 receives a contact 18. With reference to FIGS. 7 through 9, the contact 18 comprises a contact arm 19, a retention arm 20, and a solder tail 21. The flare 7 is a lead in surface for receipt of the contact 18 within the housing 1. The contact 18 is stamped from a conductive material, preferably copper. The contact arm 19 is symmetrical with the retention arm 20 about a longitudinal axis 23. The contact arm 19 is attached to the retention arm 20 at their respective bases 24. The solder tail 21 suitable for surface mount soldering processes extends from a point of attachment between the bases 24 and away from the longitudinal axis 23. A solder foot 22 is at a distal end 25 and offset from the solder tail 21. The distal end 25 is, therefore, offset from the contact arm 19 and the retention arm 20 and is off to one side of the longitudinal axis 23. For surface mount soldering processes, the solder foot 22 is sized and positioned relative to the solder tail 21 to produce a high quality fillet at a solder junction between the solder foot 22 and the printed circuit board 100. Alternatively, the solder tail 21 could extend directly along the longitudinal axis 23 and be suitable for through hole soldering processes.

With specific reference to FIG. 8, the contact arm 19 and the retention arm 20 each comprise an arcuate limb 26 and an enlarged tip 27. The limb 26 and the tip 27 meet at an obtuse angle. The tip 27 is slightly tapered being wider toward a vertex 28 of the obtuse angle and narrower at a rounded crown 29. A contact portion 30 of the tip 27 is plated with gold.

With reference to FIGS. 7 and 9, the retention arm 20 is retainably received within the chamber 2 by a three point interference fit. In the three point interference fit, the limb 26 and the crown 29 of the retention arm 20 engage the outer wall 6 and the vertex 28 of the retention arm 20, engages the inner chamber wall 8. The housing 1 is made of nonconducting material. The inner chamber wall 8 being interposed between the retention arm 20 and the groove 13 insulates the contact 18 from the substrate 101 received by the groove 13 as best seen in FIG. 9. The contact arm 19 is loosely received within the slot 3 opposite the chamber 2 that receives the retention arm 20. The retention of the contact arm 19 within the housing 1 occurs by virtue of the three point interference fit of the respective retention arm 20 and the attachment of the retention arm 20 to the contact arm 19. The vertex 28 of the contact arm 19 sits above the inner slot wall 11 and is exposed to the groove 13. In its undeflected state, the vertex 28 of the contact arm 19 lies within boundaries of the groove 13.

The groove 13 receives the substrate 101. The bevel 9 acts as a lead-in for the substrate 101. As the substrate 101 enters the groove 13, a rim 31 of the tapered tip 27 acts as a camming surface to deflect the contact arm 19 away from its longitudinal axis 23. The contact arm 19 acts as a spring member and deflects as the rim 31 engages the substrate 101. As the substrate 101 enters the groove 13 the vertex 28 of the contact arms 19 registers with the leads 102. As the substrate 101 enters the groove , the vertex 28 of the contact arm 19 wipes the corresponding lead on the substrate. When the substrate is fully seated within the groove 13, the contact arm 19 acting as a spring member causes the vertex 28 of the contact arm 19 to maintain engagement with leads 102 of the substrate 101 thereby providing for a consistent electrical connection.

Figure 11:
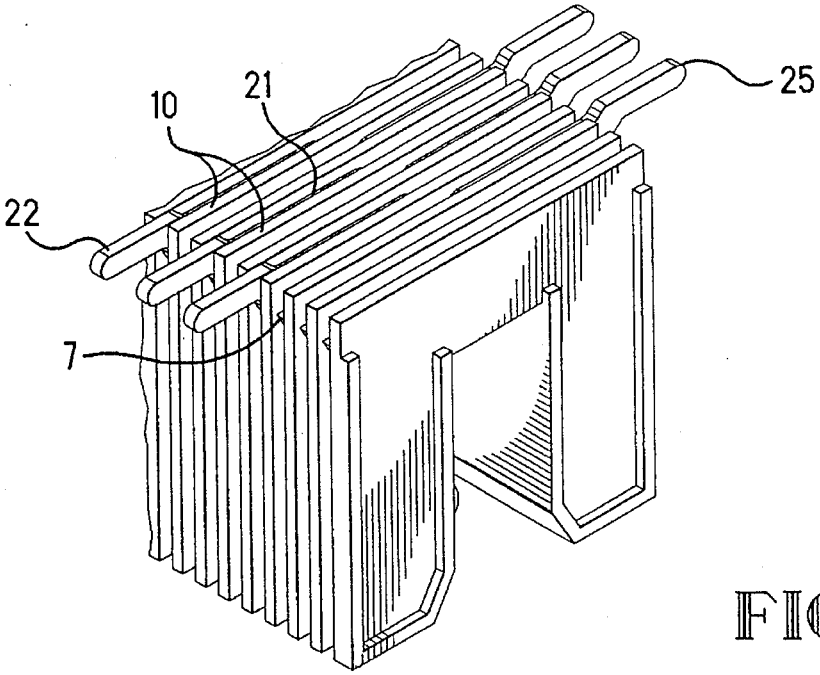
FIG. 11 is a bottom detail view of contacts within a housing having solder tails placed in alternating directions.

Due to the symmetry of the contact 18 about its longitudinal axis 23, the difference between the contact arm 19 and the retention arm 20 lies exclusively in the manner the contact 18 is retained within the housing 1. As best seen in FIGS. 1, 2, and 11, for either the single side or the double sided housing, the contacts 18 may be positioned within the housing 1 so that the distal ends 25 of the solder tails 21 are staggered, that is, the distal end 25 of one of the solder tails 21 is on an opposite side of the longitudinal axis 23 from the distal end 25 of an adjacent solder tail 21. Using the aforementioned properties, the slots 3 and chambers 2 and solder tail 21 orientations may be configured to create an in line socket having any one of four permutations of the following substrate and printed circuit board properties: a single sided substrate having 0.0125 inch centerline spacings or a double sided substrate having 0.025 inch centerline spacings interconnecting with a printed circuit board on 0.0125 inch centerline spacings or 0.025 inch centerline spacings. With reference to FIGS. 1, 2, 7, 11 and 17, a portion of the solder tails 21 not including the solder foot 22 are interstitial with the side walls 10. The side walls 10 thereby insulate adjacent contacts 18. The solder foot 22 begins at approximately where the flare 7 ends and protrudes from the housing 1. The side walls 10 are positioned relative to the contact tails 21 to vertically extend to a plane defined by the solder feet 22. The sidewalls 10 and the solder feet 22 rest on the printed circuit board 100 thereby providing flexural support for the housing 1 and reducing stresses on solder joints resulting from forces placed on the housing 1 or the substrate 101.

Figure 12:
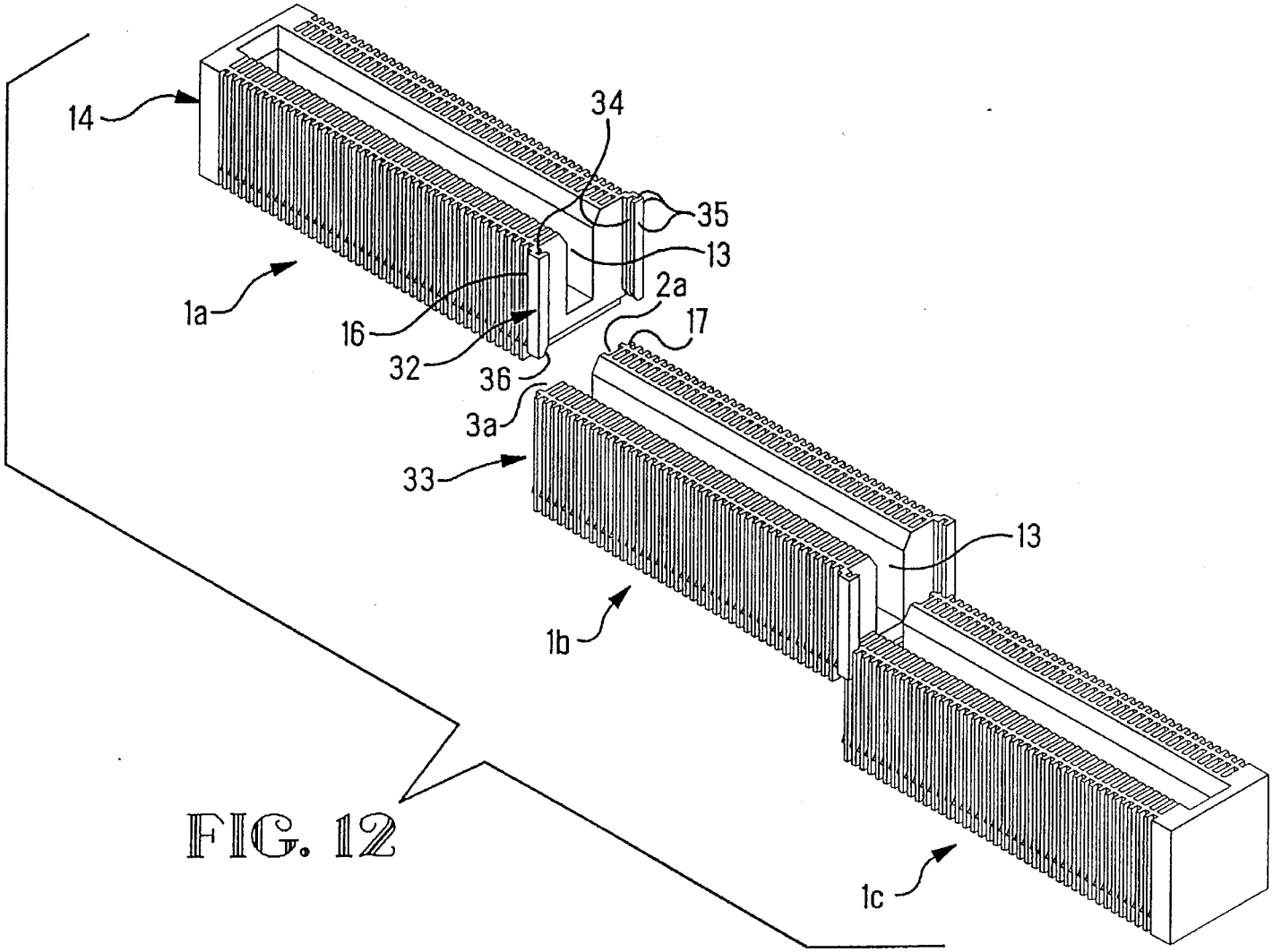
FIG. 12 is a perspective view of three separate housings offset from each other showing a fastening section and a complementary fastening section.
Figure 13:
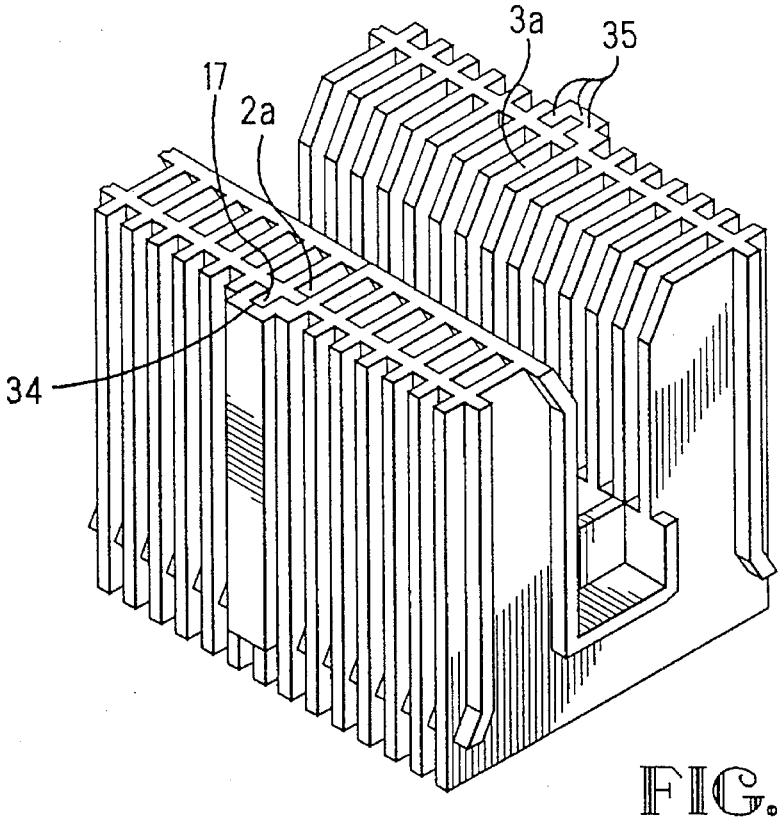
FIG. 13 is a top perspective view detailing the fastening section engaged with the complementary fastening section.
Figure 14:
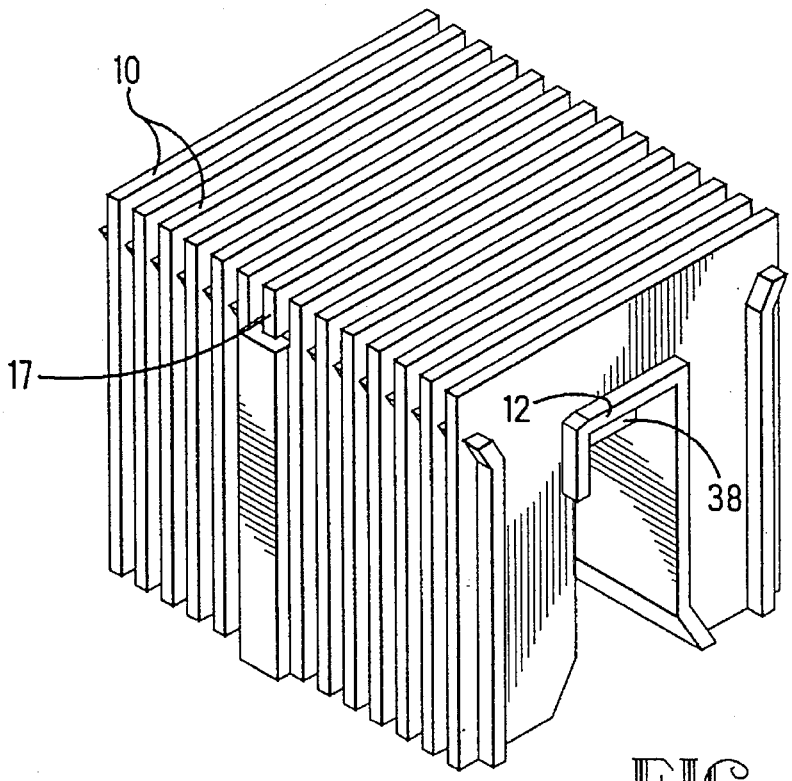
FIG. 14 is a bottom perspective view detailing the fastening section engaged with the complementary fastening section.
Figure 15:
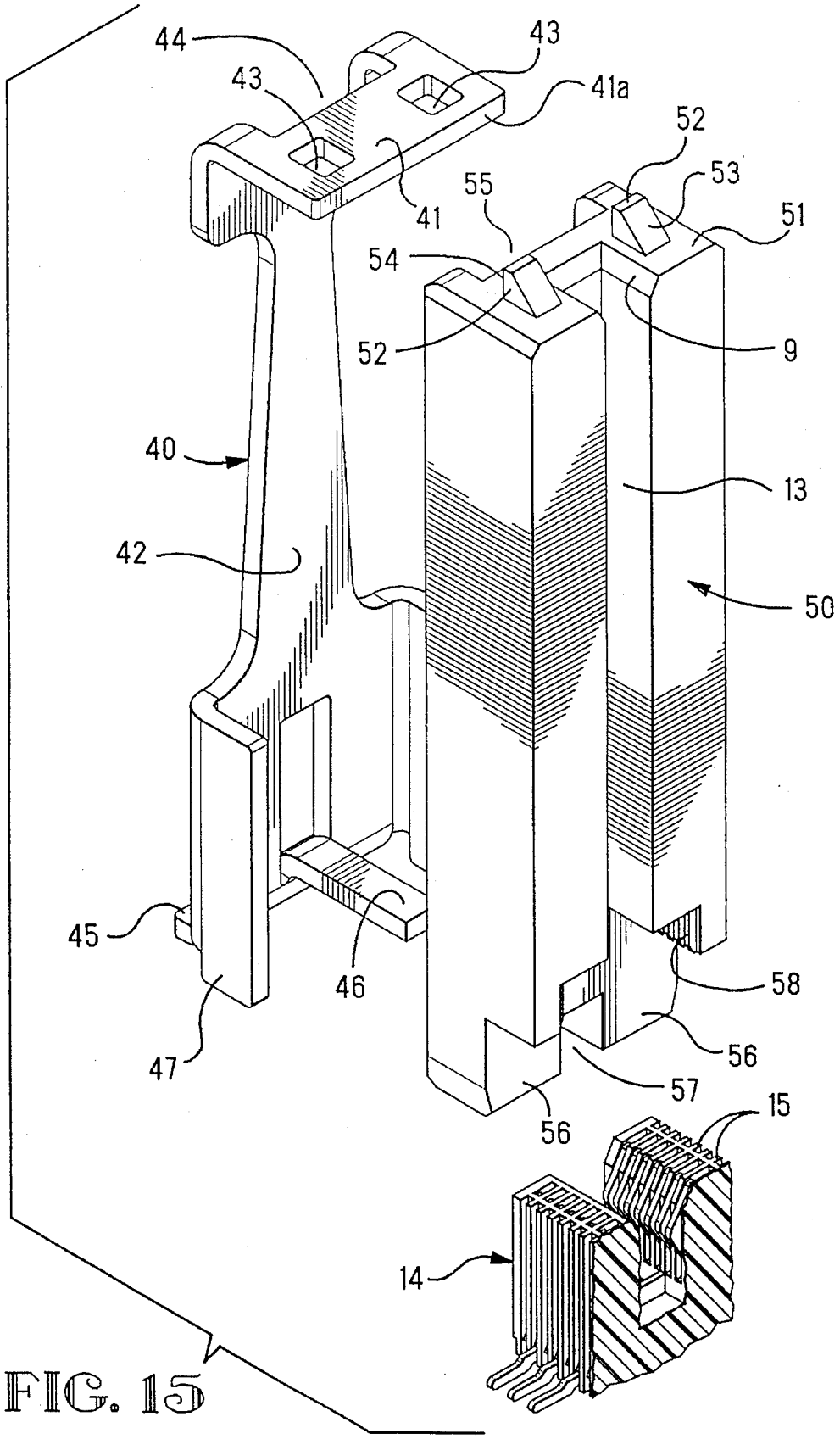
FIG. 15 is an exploded perspective view of the housing end blocks comprising an alignment block and a retention clip.
Figure 16:
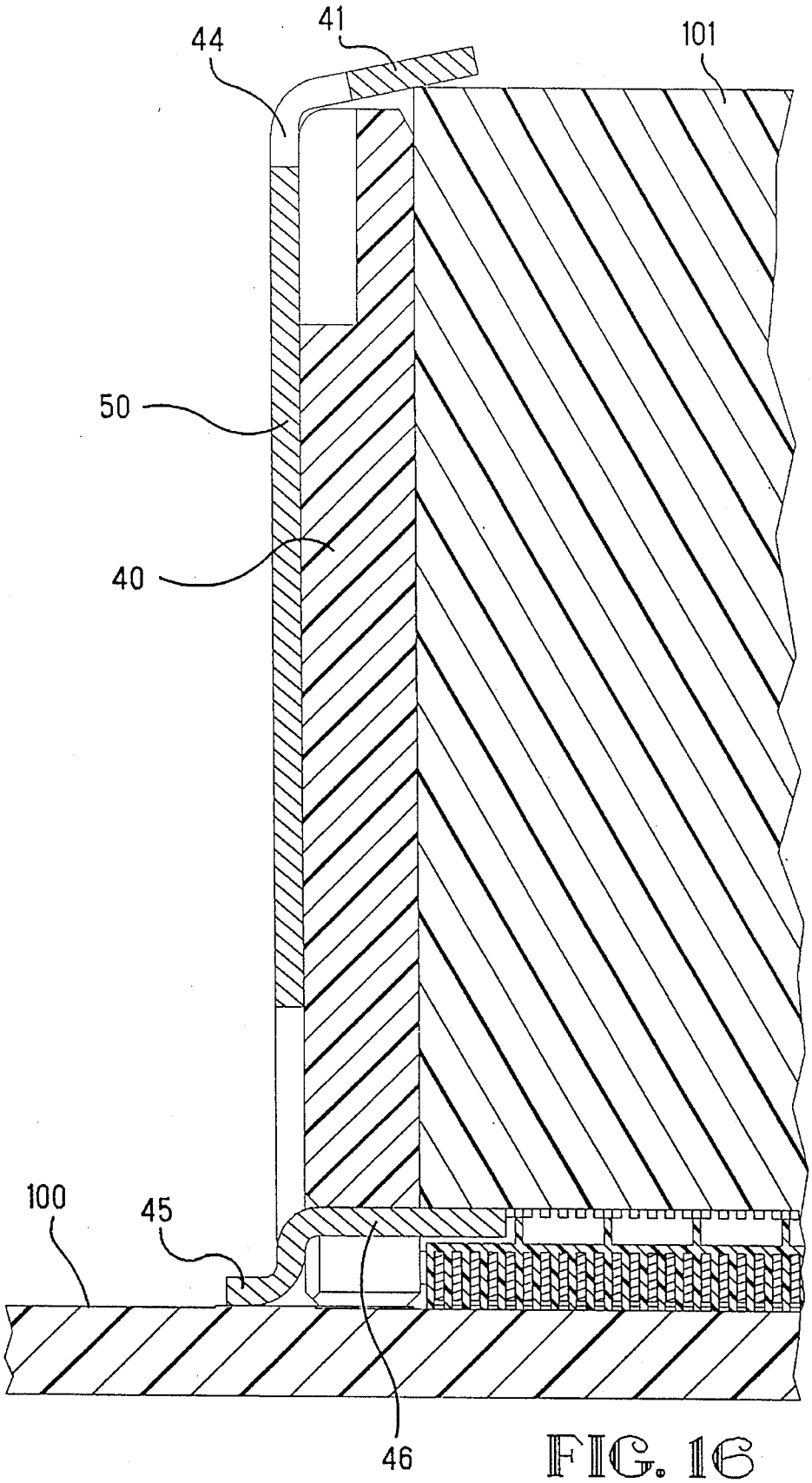
FIG. 16 is a cross sectional view of the retention clip engaging the alignment block and substrate.
Figure 17:
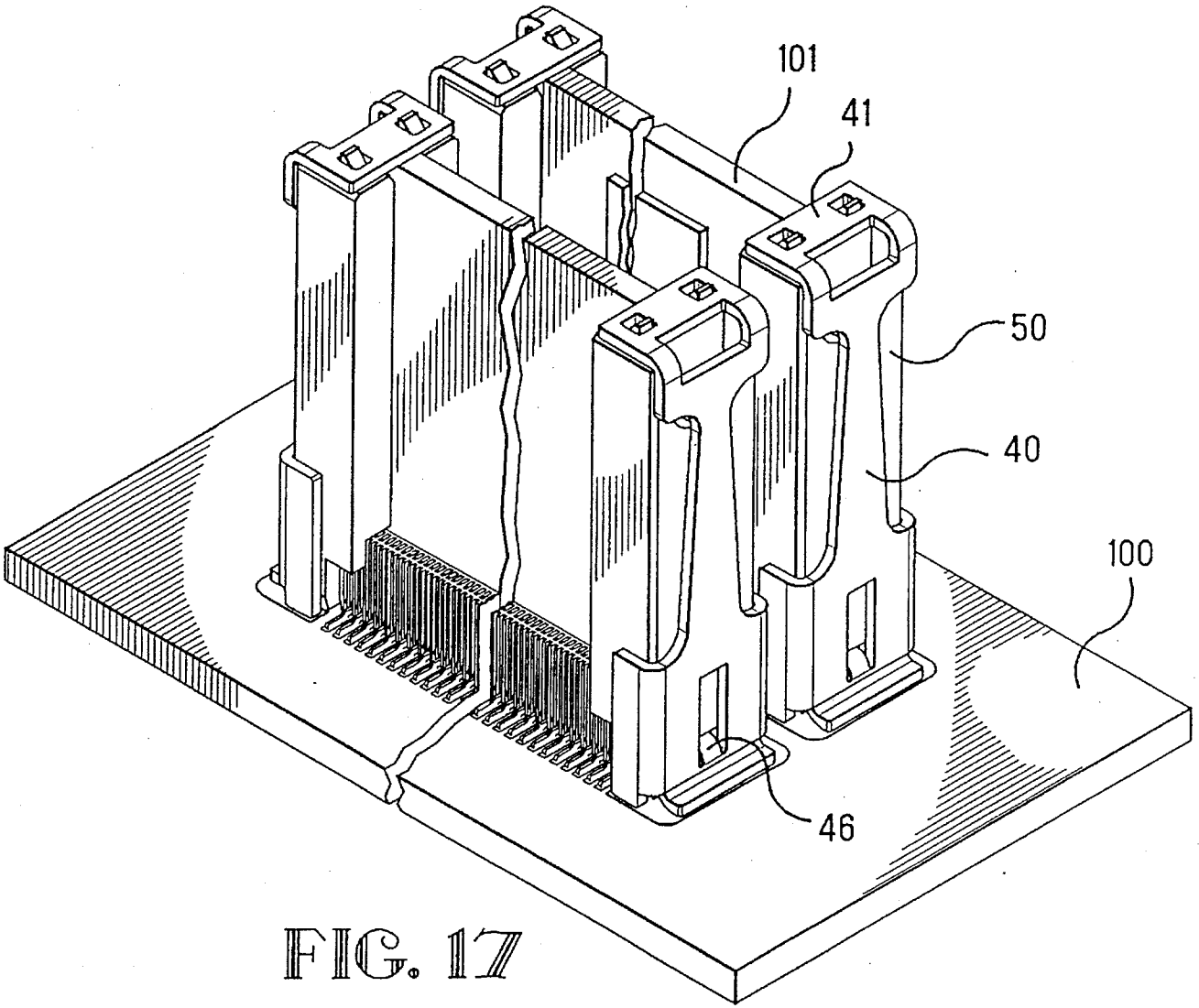
FIG. 17 is a perspective view of an assembled housing, alignment block, and retention clip on a printed circuit board and receiving a substrate.

With reference to FIGS. 12 through 14, there are shown three alternative embodiments of the housing 1 for fastening a plurality of housings 1 together to create a single housing with a lengthened substrate receiving groove 13. A first housing **1*a* has opposing side members comprising a series of the slots 3 and chambers 2 creating the substrate receiving groove 13, a single housing end 14, and a fastening section 32 at an opposite end. Alternatively, a second housing 1*b* has opposing side members creating a substrate receiving groove 13, the fastening section 32 at one end and a complementary fastening section 33 at an opposite end. Alternatively, a third housing 1*c* has a complementary fastening section 33 on one end and a housing end 14 on an opposite end. Various combinations of two or more housings 1*a*, 1*b*, 1*c* interconnect to extend the substrate receiving groove 13 to create a single housing 1 having a desired length with a single groove 13. Extension of the length of the housing 1 and groove 13 in this manner increases the number of contacts 18 received by the housing 1 for connection to substrate leads 102**.

With reference to FIG. 12, the fastening section 32 comprises two channels 34 on opposite sides of the groove 13 at an end of the housing 1*a*, 1*b*. Each channel 34 is defined by three channel walls 35, oriented at right angles with respect to each other. Openings of the channels 34 face each other. Both channels 34 are adjacent a fastening rib wall 16. Each channel 34 is offset from its respective fastening rib wall 16 a distance equal to the width of an outer wall 6. The channel walls 35 have a chamfer 36 toward a bottom 5 of the housing 1.

The complementary fastening section 33 exists by virtue of a complementary fastening rib wall 17, the outer wall 6 and an absence of one side wall 10 of an endmost chamber 2*a* and respective endmost slot 3*a*. Each channel 34 is sized and oriented to receive respective complementary fastening rib walls 17 therein. The fastening section 32 and the complementary fastening section 33 interconnect by orienting the channels 34 above the complementary fastening rib walls 17 and sliding the channels 34 over the complementary rib walls 17 until the respective grooves 13 in each housing 1*a*, 1*b*, or 1*c* align. With reference to FIGS. 13 and 14, the complementary fastening section 33 comprising; an outer wall 6, an inner chamber wall 8, and a single side wall 10 of a chamber 2, and an outer wall 6, an inner slot wall 11, and a single side wall 10 of a slot 3, combines with the fastening section 32 comprising two channels 34 and two side walls 10, to create a completed slot 3 and chamber 2. The completed slot and chamber receives a contact 18 in the completed housing 1. In this manner, two or more housings are united to form a larger housing without occupying additional space in a socket footprint to accommodate fastening means.

An alternative embodiment of the housing end 14 for either a single housing or one created by fastening a plurality of housings together using the aforementioned means is shown in FIGS. 2, and 15 through 17. In this embodiment, the substrate 101 is aligned and retained to the printed circuit board 100 by two alignment blocks 50 and cooperating retention clips 40 at each housing end 14. The alignment block 50 is preferably made of plastic or cast aluminum. The retention clip 40 is preferably stamped out of spring steel.

The retention clip 40 has an inwardly directed upper lip 41 fixably oriented at approximately right angles to a clip body 42. The upper lip 41 has two apertures 43 therein. An opening 44 at a transition between the clip body 42 and the upper lip 41 permits access to an underside of the lip 41 from an outerside of the clip body 42. At an end of the clip body 42 opposite the upper lip 41 is a outwardly directed lower lip 45 and an inwardly directed tab 46. The upper lip 41 and the tab 46 act a spring members and are resiliently biased toward each other. The lower lip 45 rests against the printed circuit board 100 and is reflow soldered thereto thereby retaining the retention clip 40 to the printed circuit board 100. Alternatively, the lower lip 45 of the retention clip 40 could be replaced by a board lock and through hole soldered to the printed circuit board 100. Inwardly directed arms 47 extend from a lower end of the body 42 and rest on the printed circuit board 100. Extension of the arms 47 increases the soldered area thereby improving the strength of the connection between the clip 40 and the printed circuit board 100.

The alignment block 50 has an upper platform 51. The upper platform 51 has two detents 52 thereon. The detents 52 have a cam surface 53 on one side, and a stop surface 54 at approximately a right angle with respect to the upper platform 51 on an opposite side. A recess 55 is in an upper portion on an outerside of the alignment block 50 and extends into the upper platform 51. The alignment block 50 has a central substrate receiving groove 13 along its length and lead in bevel 9 directly below the upper platform 51. Two feet 56 at a lower end of the alignment block 50 rest on the printed circuit board 100. The feet 56 are chamfered to promote a good solder fillet around the arms 47 of the retention clip 40 during the reflow solder process. The feet 56 are parallel to and separated from each other by a central notch 57. Two sets of alignment ribs 58 are on opposite sides of the groove 13 in the alignment block 50. The alignment ribs 58 are directed toward each other and are sized and oriented to interstitially mate with rib walls 15 at the respective housing ends 14 while the alignment block 50 covers a portion of the top 4 of the housing 1.

The alignment block 50 and the retention clip 40 cooperate to precisely align and retain the substrate 101. The retention clip 40 is surface mount reflow soldered to the printed circuit board 100. The alignment block 50 fits over the tab 46 and under the upper lip 41 such that the tab 46 extends through the notch 57 and protrudes from the alignment block 50 and into the groove 13 in the housing 1. The alignment ribs 58 interstitially mate with respective rib walls 15 of the housing 1. The groove 13 in the alignment block is precisely sized to provide proper registration of the substrate 101 relative to the housing 1. The alignment ribs 58 provide precise registration of the alignment block 50 relative to the housing 1. The tab 46 protrudes from the alignment block 50 and into the groove 13 which also aids in retention of the housing 1 onto the printed circuit board 100. The tab 46 is resiliently biased toward the upper lip 41, the substrate 101 being received therebetween. There is some clearance between the tab 46 and support walls 38. The clearance provides a certain amount of travel in the tab before it places a force on the housing 1 as a result of a force on the substrate 101.

Prior to installation of the substrate 100, the upper lip 41 is disengaged from the alignment block 50 and is clear of the groove 13 in the alignment block 50. The stop surfaces 54 maintain the upper lip 41 clear of the groove 13 during the installation and deinstallation processes. Installation of the substrate 100 includes positioning the edge of the substrate 100 directly above the bevel 9 in the alignment blocks 50 and drawing the substrate 100 into the groove 13 on the alignment block 50. The substrate 100 is drawn further into the groove 13 on the alignment block 50 and into the groove 13 in the housing 1 until it is fully seated and resting on the tabs 45. The alignment block 50 is of sufficient height to assure that as the substrate 100 enters and is seated within the groove 13 in the housing 1, it is parallel to the longitudinal axis 23 of all of the contacts 18 within the housing 1. When the substrate 100 is fully seated, the upper lip 41 may be positioned for retention of the substrate 101.

To install, a tool(not shown) such as a conventional flat head screw driver is positioned into the opening 44 and between the upper lip 41 and the upper platform 51. The tool is used to pry the upper lip 41 up and away from the upper platform 51 such that the upper lip 41 disengages the stop surfaces 54. Due to the spring qualities of the clip 40, the clip 40 will move inwardly such that the apertures 43 engage the detents 52 on the upper platform 51. The retention clip 40, therefore, captures the alignment block 50 between the upper lip 41 and the tab 46, retaining it. The upper lip 41 covers the substrate receiving groove 13 in the alignment block 50 thereby also covering a portion of a substrate edge 103*a* opposite the substrate edge 103 having leads 102 thereupon. The upper lip 41 interferes with egress of the substrate 100 and retains the substrate 100 within the groove 13.

Deinstallation of the substrate 100 requires the tool be inserted into opening 44 and downwardly between the clip body 42 and alignment block 50. Once inserted, the tool is used to pry the clip body 42 away from the alignment block 50. The cam surfaces 53 permit disengagement of the detents 52 and apertures 43 so that the upper lip 41 moves away from the upper platform 51 until the upper lip 41 completely clears the detents 52. When the upper lip 41 clears the detents, the spring qualities of the clip 40 and upper lip 41 cause the upper lip 41 to deflect toward the upper platform 51 and the clip body to deflect toward the groove 13 so that an upper lip rim 41*a* engages the stop surfaces 54. The stop surfaces 54 prevent the upper lip 41 from moving toward the groove 13. The height of the alignment block 50 is such that deinstallation of the substrate 100 may be accomplished only by removing the substrate in a direction parallel to the longitudinal axis 23 of the contacts 18.

We claim:

1. An electrical edge connector housing comprising:

(a). a first housing comprising:

(i). opposing side members creating a first substrate receiving groove, (ii). a first end, and (iii). a second end having a fastening section, (b). a second housing comprising:

(i). opposing side members creating a second substrate receiving groove, (ii). a first end, and (iii). a second end having a complementary fastening section engageable with said fastening section, wherein, when said fastening section engages said complementary fastening section, said first and second substrate receiving grooves align to create a single uninterrupted substrate receiving groove.

2. A first electrical edge connector housing as in claim 1 wherein said fastening member comprises a channel and said complementary fastening member is a rib received within said channel.

3. An electrical edge connector as in claim 1 wherein said fastening section and said complementary fastening section engage creating a chamber and associated slot.

4. An apparatus for retaining a substrate in perpendicular alignment with respect to a printed circuit board comprising:

(a). two alignment blocks, each said alignment block having a substrate receiving groove and a notch therewithin, and (b). two retention clips, each said retention clip mounted to the printed circuit board, engageable with a respective said alignment block, said retention clip having an upper lip and a tab resiliently biased toward each other, said tab protruding through said notch wherein, said upper lip and said tab are adapted to engage the substrate therebetween, retaining it, and further wherein said groove is adapted to maintain the substrate in perpendicular orientation with respect to the printed circuit board.

5. The apparatus of claim 4 wherein, said alignment block has a detent and said retention clip has a aperture engaging said detent.

6. The apparatus of claim 4 further comprising: a housing having rib walls, and wherein said alignment block has alignment ribs engageable with said rib walls to precisely align said alignment block to said housing.

* * * * *